United States Patent [19]

Starkie

[11] Patent Number: 4,608,533

[45] Date of Patent: Aug. 26, 1986

[54] AUTOMATIC COMPENSATION CIRCUIT FOR USE WITH ANALOG MULTIPLIER

[75] Inventor: Alan H. Starkie, San Jose, Calif.

[73] Assignee: Electric Power Research Institute, Inc., Palo Alto, Calif.

[21] Appl. No.: 506,675

[22] Filed: Jun. 22, 1983

[51] Int. Cl.[4] ..... G06G 7/16

[52] U.S. Cl. ..... 324/142; 324/130; 330/9; 364/841; 364/844

[58] Field of Search ..... 324/142, 130, 140 R, 324/140 D; 330/9; 364/841, 842, 483, 844, 843; 340/347 CC; 328/160

[56] References Cited

U.S. PATENT DOCUMENTS 3,541,446 11/1970 Prozeller ..... 324/130 X 3,801,919 4/1974 Wilkes et al. ..... 330/9

4,118,787 10/1978 Arnoux ..... 324/142 X 4,297,642 10/1981 Baldwin et al. ..... 330/9

*Primary Examiner*—Jerry W. Myracle

*Assistant Examiner*—Stephen M. Baker

*Attorney, Agent, or Firm*—Flehr, Hohbach, Test, Albritton & Herbert

[57] ABSTRACT

An automatic compensation circuit for use with an analog multiplier is disclosed. At regular intervals at least one input to the analog multiplier is constrained to be zero for a short time. During this time a sample and hold circuit retains the pre-existing output voltage and a feedback circuit is activated which adjusts the output voltage of the multiplier to zero, thereby providing an accurate multiplied or product signal, typically representing power consumption, which is adjusted or compensated for the effects of any internal errors occurring within the analog multiplier.

4 Claims, 2 Drawing Figures

AUTOMATIC COMPENSATION CIRCUIT FOR USE WITH ANALOG MULTIPLIER

BACKGROUND OF THE INVENTION

The present invention relates to an automatic compensation circuit for use with an analog multiplier. As is known in the prior art, analog multipliers are utilized for a wide variety of applications. For instance, in an electrical power measurement application where accurate power consumption measurement is desired, a first signal representing instantaneous voltage potential is multiplied with a second signal representing instantaneous electrical current with the resulting third product signal representing power consumption in wattage ($V \times I\cos\theta = W$).

Analog multipliers used in such environment can therefore be utilized in an electronic watt-hour meter in order to provide the necessary calculation for determining watt-hour consumption. It is quite important that the power consumption be extremely accurate over a wide range of current input values. However, a problem with using an analog multiplier to perform the calculation is that current and voltage offsets occur because of transistor mismatches within the analog multiplier which can introduce errors into the power measurement calculation.

In particular, proportionally large error signals can be introduced into the power calculation during periods when the current signals are small. Because of the inherent limitations with analog multipliers, the calculation will likely have some value other than the true expected value, which is clearly undesirable. One prior art approach utilizes potentiometers which are set up during production testing to provide zero output offset, which requires extra time and component costs. This requirement for stabilizing the offset characteristics of an analog multiplier is an undesirable problem which has been generally present in such implementations.

While automatic compensation techniques are generally known, there have not been any such applications for use with an analog multiplier, which would reduce the component cost and provide improved accuracy. It would be desirable, therefore, to overcome these deficiencies by providing an improved implementation which eliminates the prior art approaches. In view of the above background, it is an objective of the present invention to provide an automatic compensation circuit for use with an analog multiplier.

SUMMARY OF THE INVENTION

The general objective of the present invention is achieved by providing, in one preferred embodiment, inputs to an analog multiplier which are a first signal representing the instantaneous electrical current consumption for an electronic watt-hour meter and a second input signal representing instantaneous voltage potential for the same meter. The analog multiplier is utilized to multiply the first and second inputs to generate a third product signal representing power consumption.

At regular intervals corresponding to the zero crossing points of the voltage signal, the current input to the analog multiplier is constrained to be zero for a short time. During this time, a sample and hold circuit retains the pre-existing output voltage and a feedback circuit is activated which automatically adjusts the output voltage of the multiplier to zero. By providing this automatic adjustment feature, the offset characteristics of the analog multiplier are stabilized, while providing for improved accuracy of the power consumption measurement.

In view of the foregoing summary, the present invention achieves the objective of providing an improved automatic compensation circuit for use with an analog multiplier.

Other objects and features of the present invention will become apparent from the following detailed description when taken in conjunction with the accompanying drawings.

DETAILED DESCRIPTION OF THE DRAWINGS

Figure 1:
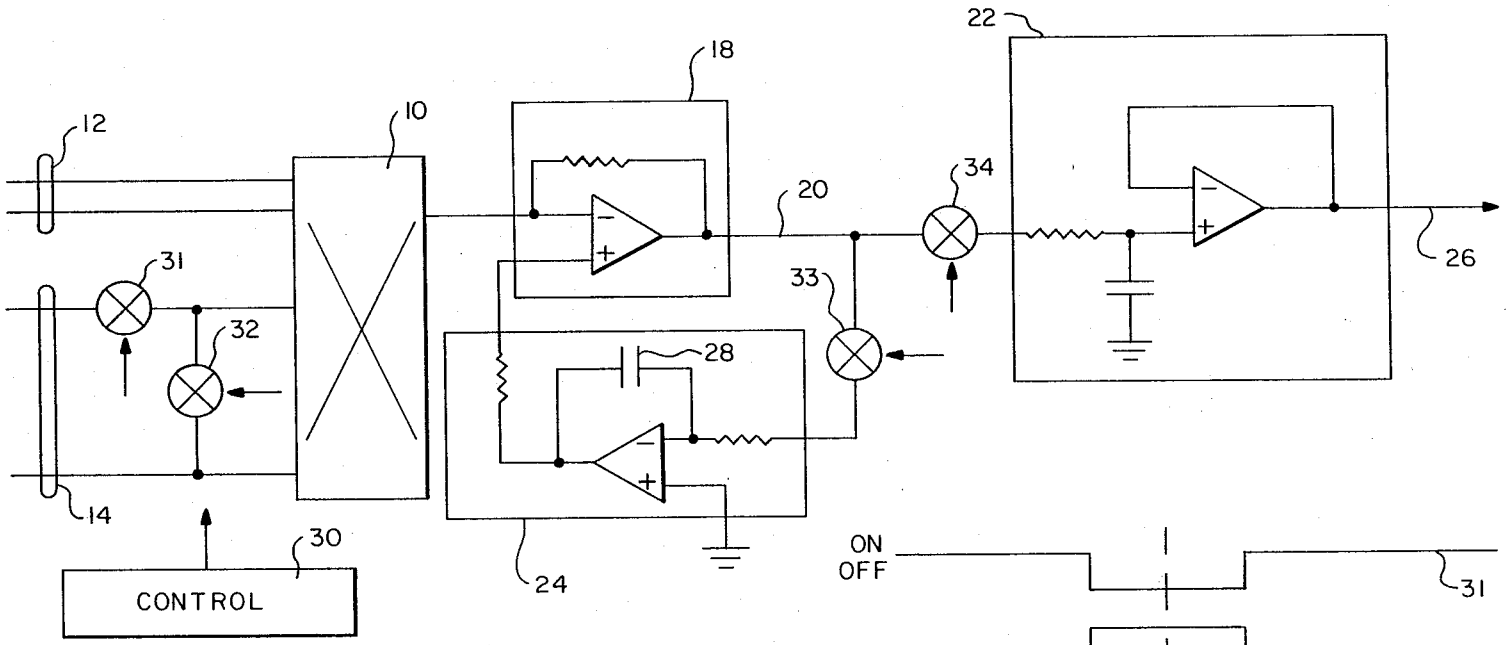
FIG. 1 depicts a schematic diagram of an automatic compensation circuit for use with an analog multiplier according to the present invention.

Referring now to FIG. 1, an automatic compensation circuit for use with an analog multiplier is depicted.

As has previously been described, error signals can occur with an analog multiplier which is an undesirable aspect of the particular circuits. In a preferred implementation, the present invention utilizes an automatic compensation circuit for use with an analog multiplier for calculating power consumption in wattage. In such an application, the particular analog multiplier can be utilized in an electronic watt-hour meter in order to provide accurate calculations representing power consumption. It should be understood that the present invention can be applied to other types of application in which the use of an analog multiplier is desired. However, for purposes of explanation, the description of the present invention when taken in conjunction with FIGS. 1 and 2, will be described assuming that the input signals to the analog multiplier are a first signal representing instantaneous voltage potential and a second signal representing instantaneous electrical current. The resulting multiplied signal by the analog multiplier will therefore be a product signal representing power consumption in wattage.

Referring again to FIG. 1, an analog multiplier 10 is connected to receive a first input signal on bus 12 which represents instantaneous voltage potential. A second signal on bus 14 is connected to analog multiplier 10. The second input signal typically represents instantaneous electrical current.

As is known in the art, an analog multiplier such as multiplier 10 will generate a third product signal which, in a preferred implementation, represents the power consumption.

In FIG. 1, multiplier 10, which is typically Raytheon's RC4200 Precision Analog Multiplier, generates a current or product signal on bus 16 for connection to operational amplifier circuit 18 (typically Model No. LM442CN). The purpose of operational amplifier circuit 18 is to convert the current signal on bus 16 to a voltage signal on bus 20. Operational amplifier circuit 18 can therefore be considered a conditioning circuit.

In FIG. 1, the input signal on bus 14 is normally connected to the analog multiplier circuit 10 through switch 31, which in normal operation is in a closed or "ON" position. A second switch 32 is connected across bus 14 and is normally in an open or "OFF" position.

In normal operation the output of the compensation circuit 18 is connected via bus 20 through a switch 34 to sample and hold circuit 22. The signal on bus 20 can also be connected through switch 33 to integrator circuit 24, which is a feedback circuit connected to the positive (+) input of conditioning circuit 18. A control circuit 30 provides suitable control signals for connection to switches 31, 32, 33 and 34. As will be described, the operation of the control circuit 20 is straightforward and consequently the component details of control circuit 20 need not be described in detail.

As described above, in normal operation the power consumption information is generated by the improved circuit with switches 31 and 34 in a closed position and with switches 32 and 33 in an open position. Under that condition, the voltage and current signals on buses 12 and 14 are multiplied by analog multiplier 10 which forms a third product signal or current signal on bus 16. That product signal on bus 16 is then conditioned by conditioning circuit 18 to form a voltage signal on bus 34 which is connected through switch 34 to sample and hold circuit 22, which further conditions the product signal. The output signal on bus 26 then represents power consumption in wattage, which can be utilized in a normal fashion. However, as previously described, errors can be introduced into the power consumption signal. During zero crossing conditions of an AC signal, the zero value of the voltage and/or current signals should result in a zero value power consumption signal. Because of the inherent deficiencies of analog multipliers, offsets can occur which result in an error signal being generated.

In FIG. 1, during zero crossing conditions of the voltage signals, switch 31 is opened and switch 32 is closed by control circuit 30, which will result in a zero input into multiplier 10. At the same time, switch 34 is opened and switch 33 is closed, which will enable integrator circuit 24 to adjust the output of compensation circuit 18 to zero. Sample and hold circuit 22 contains the pre-existing output voltage. Consequently, it can be seen that through automatic compensation, the error signals which are normally introduced in an analog multiplier can be greatly reduced.

Figure 2:
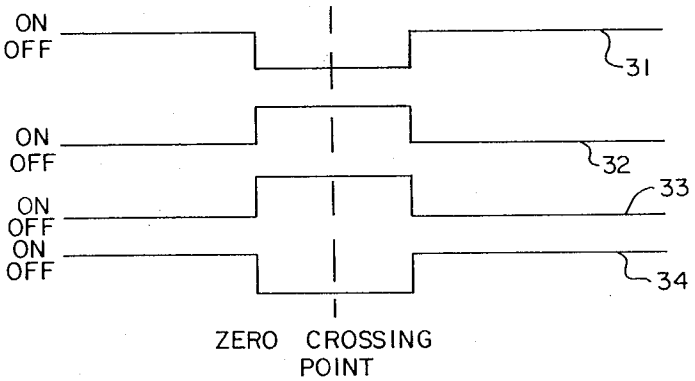
FIG. 2 depicts a timing diagram for the compensation circuit of FIG. 1.

In order to fully understand the operation of the present invention, the detailed cycle of operation will be described in conjunction with FIGS. 1 and 2 during the zero crossing points (see FIG. 2) of the voltage signal on bus 12. (The detection of zero crossing points is well known in the art.)

During regular specified intervals, (e.g., the zero crossing point), control circuit 30 opens switch 34 and then opens switch 31 and closes switch 32, thereby presenting a zero input value to multiplier 10. Switch 34 is opened in order to allow sample and hold circuit 22 to retain its existing output voltage during the automatic compensation sequence. This is done so that if a spurious pulse on the line triggers an automatic compensation sequence at a time other than the zero crossing, the output transient of power consumption signal 26 is minimized. Switch 33 is then closed and integrating amplifier 24 adjusts the positive input of compensation circuit 18 until its output on bus 20 is zero. Control circuit 30 then opens switch 33 and capacitor 28 stores the correction voltage during the next half cycle of the line voltage.

The current input signal is then reapplied to multiplier 10 (control circuit 30 closes switch 31 and opens switch 32). Finally, switch 34 is closed which ends the automatic compensation sequence.

As will be appreciated by one skilled in the art, an automatic compensation circuit for use with an analog multiplier has been described in conjunction with power measurement consumption. However, it should be equally clear to one skilled in the art that the present invention can be applied to other applications utilizing an analog multiplier. Consequently, while the present invention has been described in conjunction for use in an electronic watt-hour meter, the scope of the specific subject matter should only be limited by the scope of the accompanying claims.

I claim:

1. An automatic compensation circuit comprising an analog multiplier connected to receive a first signal representing instantaneous voltage and a second signal representing instantaneous current for generating a third current signal representing the product of said first and second signals, means for converting said third current signal to a fourth voltage signal, and compensation means connected to said converting means for adjusting the output of said converting means to zero during zero crossing points of at least one of said first or second signals.

2. In an electronic watt-hour meter, an automatic compensation circuit comprising an analog multiplier connected to receive a first signal representing instantaneous voltage and a second signal representing instantaneous current for generating a third current signal representing the product of said first and seconds signals, means for converting said third signal to a fourth voltage signal, compensation means connected to said converting means for adjusting the output of said converting means to zero during zero crossing points of at least one of said first or second signals, and sample and hold means for storing the fourth voltage signal during the respective interval.

3. A circuit as in claim 2 including first switch means for normally connecting said first signal to said analog multiplier, second switch means for connecting a zero value to said analog multiplier during said zero crossings of said first or second signals, and control means for controlling said first and second switch means.

4. A circuit as in claim 3 including third switch means for normally connecting said fourth signal to said sample and hold means, fourth switch means for connecting said fourth signal through said compensation means to said connecting means during said zero crossing points of said first or second signals, and control means for controlling said third and fourth switch means.

* * * * *